US007744308B2

(12) United States Patent
Bussey, Jr. et al.

(10) Patent No.: US 7,744,308 B2
(45) Date of Patent: Jun. 29, 2010

(54) DRAINAGE ELEMENT OF OVATE SHAPE AND METHOD OF MAKING

(75) Inventors: Harry Bussey, Jr., Marco Island, FL (US); Buddy Harry Bussey, III, Atlantic Highlands, NJ (US)

(73) Assignee: ICC Technologies Inc., Marlboro, NJ (US)

( * ) Notice: Subject to any disclaimer, the term of this patent is extended or adjusted under 35 U.S.C. 154(b) by 638 days.

(21) Appl. No.: 11/506,332

(22) Filed: Aug. 18, 2006

(65) Prior Publication Data

US 2008/0044228 A1 Feb. 21, 2008

(51) Int. Cl.
*E02B 11/00* (2006.01)

(52) U.S. Cl. ..... 405/45; 405/36; 405/43

(58) Field of Classification Search ..... 405/36, 405/43, 45, 50

See application file for complete search history.

(56) References Cited

U.S. PATENT DOCUMENTS 4,288,321 A * 9/1981 Beane ..... 210/170.07
4,500,586 A * 2/1985 Bussey, Jr. ..... 428/174
5,639,364 A * 6/1997 Houck et al. ..... 210/170.01
6,315,493 B2 * 11/2001 Malone et al. ..... 405/45
6,641,335 B1 * 11/2003 Allard ..... 405/302.6
6,854,924 B2 * 2/2005 Ring ..... 405/45
2004/0057797 A1 * 3/2004 Ring ..... 405/46
2005/0063781 A1 * 3/2005 Bussey et al. ..... 405/43

FOREIGN PATENT DOCUMENTS

JP 60059230 A * 4/1985

* cited by examiner

*Primary Examiner*—David J Bagnell
*Assistant Examiner*—Benjamin Fiorello
(74) *Attorney, Agent, or Firm*—Francis C. Hand; Carella, Byrne, et al

(57) ABSTRACT

The drainage element is formed of a tubular mesh that is filled with loose fill elements of polymeric material, deformed into an ovate cross-sectional shape and cured at an ambient temperature to hold the elements in a compacted state to define a rigid drainage element. The drainage element may be fabricated with a perforated pipe to be joined to other like drainage elements in a drainage system.

9 Claims, 5 Drawing Sheets

DRAINAGE ELEMENT OF OVATE SHAPE AND METHOD OF MAKING

This invention relates to a drainage element of ovate cross-sectional shape and to a method of making the same. More particularly, this invention relates to a drainage element of ovate cross-sectional shape for use in a drainage system.

As is known, drainage elements have been constructed of a perforated plastic pipe surrounded by loose aggregate, such as foam plastic elements, beads, and other light weight materials, that are kept in place by an enveloping sleeve of mesh or the like for use in a sewage field, water drainage field, roadside drainage ditches and the like. Various techniques have also been known for making such drainage elements in a manufacturing plant in lengths of 10 feet or more so that the individual drainage elements may then be shipped to a construction site for use. Examples of such techniques are described in U.S. Pat. Nos. 5,015,123; 5,154,543; 5,535,499; 5,657,527; and 6,173,483.

Typically, the drainage elements are formed with a cylindrical cross-section. Thus, when such drainage elements are placed in a trench in the field as part of an overall drainage system, the plane of the cross-section of the drainage element presented for drainage is limited to the diameter of the drainage element. That is to say, where the drainage element is used in a septic tank system, the effluent from a perforated pipe within the drainage unit is dispersed primarily downwardly under gravity and flows through the aggregate in a spread pattern from about a four o'clock position to an eight o'clock position, as viewed in cross-section.

In the case where the drainage element is used to draw off water from a field, the water typically permeates through the upper surfaces of the drainage element from about a ten o'clock position to a two o'clock position, as viewed in cross-section, into the perforated pipe. Further, where the pipe is perforated throughout the circumference, there is leakage of the water through the perforations located, at least, in the bottom half of the pipe back into the trench.

Where a trench is of large width, a pair of drainage elements would be placed side-by-side in the bottom of the trench. However, the effective areas of the two drainage elements for the passage of effluent or water from or into the perforated pipes is reduced. In order to increase the effective area of a drainage element, use may be made of a ground water drainage device, as described in U.S. Pat. No. 3,441,140, that is comprised of an elongated flat and flexible envelope that has been compartmentalized by joining the opposite walls thereof to each other along substantially their entire width at intervals and loosely filled with granules of water-insoluble material. The device is also described as capable of being bent and rolled up for ease of storage, transportation and the like.

It is an object of this invention to provide a light weight drainage element made of elements of polymer material that is of an ovate cross-sectional shape.

It is another object of the invention to provide a drainage element that increases the efficiency of dispersing effluent from a septic tank system.

It is another object of the invention to increase the efficiency of a drainage element for drawing off water in a drainage system.

It is another object of the invention to provide an economical and efficient method of making a drainage element of ovate cross-sectional shape.

Briefly, the invention provides a drainage element of rigid ovate cross-sectional shape that is comprised of a tube having closed opposite ends and a mass of loose fill elements of polymeric material of non-spherical shape disposed within the tube between the ends in a tightly compacted state. The shape and compaction of the loose fill elements are characterized in that the elements resist movement relative to each other thereby imparting a degree of rigidity to the drainage element that resists deformation of the drainage element from the ovate cross-sectional shape imparted upon manufacture under a loading of at least 2 psi.

The tube is constructed with at least one water permeable section to allow water and/or effluent to pass therethrough. Depending upon the use of the drainage element, the tube may have one or more sections having a porosity or permeability to prevent the passage of water or effluent therethrough in order to retain the water or effluent within the mass of loose fill elements.

The tube may be made of a plastic mesh fabric of monofilaments. However, it has been found that a tube that has been made of a knitted mesh fabric of multi-filaments enhances the rigidity of the finished drainage element. Also, the tube may be made as a silk sock to provide a finer mesh.

The drainage element may further include a length of perforated pipe that extends within the tube and loose fill elements and that extends from each end of the tube for connection to a pipe of a like adjacent drainage element in a drainage system.

The loose fill elements that are employed in the drainage element are supplied in an expanded state but with the capability of being further expanded upon curing. Such elements are described in co-pending U.S. patent application Ser. No. 11/248,753 filed Oct. 12, 2005.

The invention further provides a drainage system for a hillside or sloped surface wherein a drainage element of ovate cross-sectional shape is disposed in a trench in such a manner that the upper section of the drainage element extends outwardly of the trench. In this embodiment, the major axis of the drainage element is disposed perpendicularly of the trench, i.e. generally vertically. During use, where the tube is made of a mesh, water flowing down the hillside enters through the mesh into the interior of the drainage unit and drains through the perforated pipe within the drainage element to a suitable site. Alternatively, the circumferential portion of the drainage element that projects from the trench on the upside of the hill or sloped surface may provided with openings for passage of water into the interior of the drainage element while the opposite exposed side of the drainage element has a permeability to prevent the passage of water to ensure that any water that enters into the drainage element is retained within the drainage element to be drawn off through the perforated pipe within the drainage element.

The drainage element may also be disposed within a trench so that the major axis is horizontally disposed within the bottom of the trench. This allows the drainage element to present a larger surface area to water flowing into the drainage element from above as well as providing a greater surface area for effluent to flow from the drainage element where used in a septic field as compared to cylindrical drainage elements.

The invention also provides a relatively inexpensive and economical method of making a drainage element of ovate cross-sectional shape.

In one embodiment, a tube of material having at least one water permeable section is positioned on a tubular sleeve. Thereafter, a free end of the tube is pulled from the sleeve and closed in any suitable manner, for example, using a tie or staple. Thereafter, a mass of expanded loose fill elements of polymeric material is supplied into the tube, for example by a pneumatic blower, while the tube is simultaneously moved from the sleeve.

After a predetermined length of the tube has been filled, the supply of loose fill material is stopped. The rear end of the tube is then closed on the fly in order to retain the loose fill elements therein and to form a tubular unit. Alternatively, the feeding of the tube from the sleeve may also be stopped and the rear end of the tube closed.

In one embodiment, upon passing from the sleeve, the filled tube is passed between a pair of parallel components, for example a pair of parallel bars, or a pair of rollers, or a catapuller adjacent to the end of the sleeve in order to deform the filled tube into an ovate cross-sectional shape. Since the tube has not yet been closed, the loose fill elements are able to shift relative to each other under the force of deformation to accommodate the deformed ovate cross-sectional shape.

In another embodiment, after the tube has been closed, the resultant tubular unit is passed between a pair of parallel components, for example a pair of parallel bars or a pair of rollers or a catapuller, downstream of the sleeve in order to deform the filled tube into an ovate cross-sectional shape.

Thereafter, the tubular unit is subjected to a curing step in which the unit is exposed to an ambient temperature over a time, e.g. 24 hours, sufficient to cure the loose fill elements thereby effecting a post expansion of the loose fill elements. During the curing step, the loose fill elements first contract as the blowing agent within the elements condense from a gaseous state to a liquid state. Due to the vacuum which is created in the cells by the condensing blowing agent, air is drawn into the cells over time thereby expanding the elements. The amount of expansion is typically 10% of the original volume. However, the manufacture of the loose fill elements may be controlled to allow expansions of 3% or 30%.

As the loose fill elements are cured and expanded, the elements become compacted within the tube and rigidify the tubular unit in the ovate cross-sectional shape imparted during manufacture. During this time, the elements interlock and do not move appreciably due to friction.

In another embodiment, the tubular sleeve may be made of elliptical cross-section so that the tubular unit being formed by the tube and loose fill elements is of an ovate cross-sectional shape as manufactured. In this embodiment, there would be no need to compress the tubular unit between a pair of parallel components in order to deform the unit into an ovate cross-sectional shape. Further, in this embodiment, while the loose fill elements may gravitate towards a cylindrical shape from the elliptical cross-section shape imparted by the sleeve, curing of the loose fill elements to effect expansion and rigidification of the tubular unit prevents migration towards a cylindrical cross-sectional shape and locks in the ovate cross-sectional shape imparted by the elliptical sleeve.

These and other objects and advantages of the invention will become more apparent from the following detailed description taken in conjunction with the accompanying drawings wherein.

Figure 1:
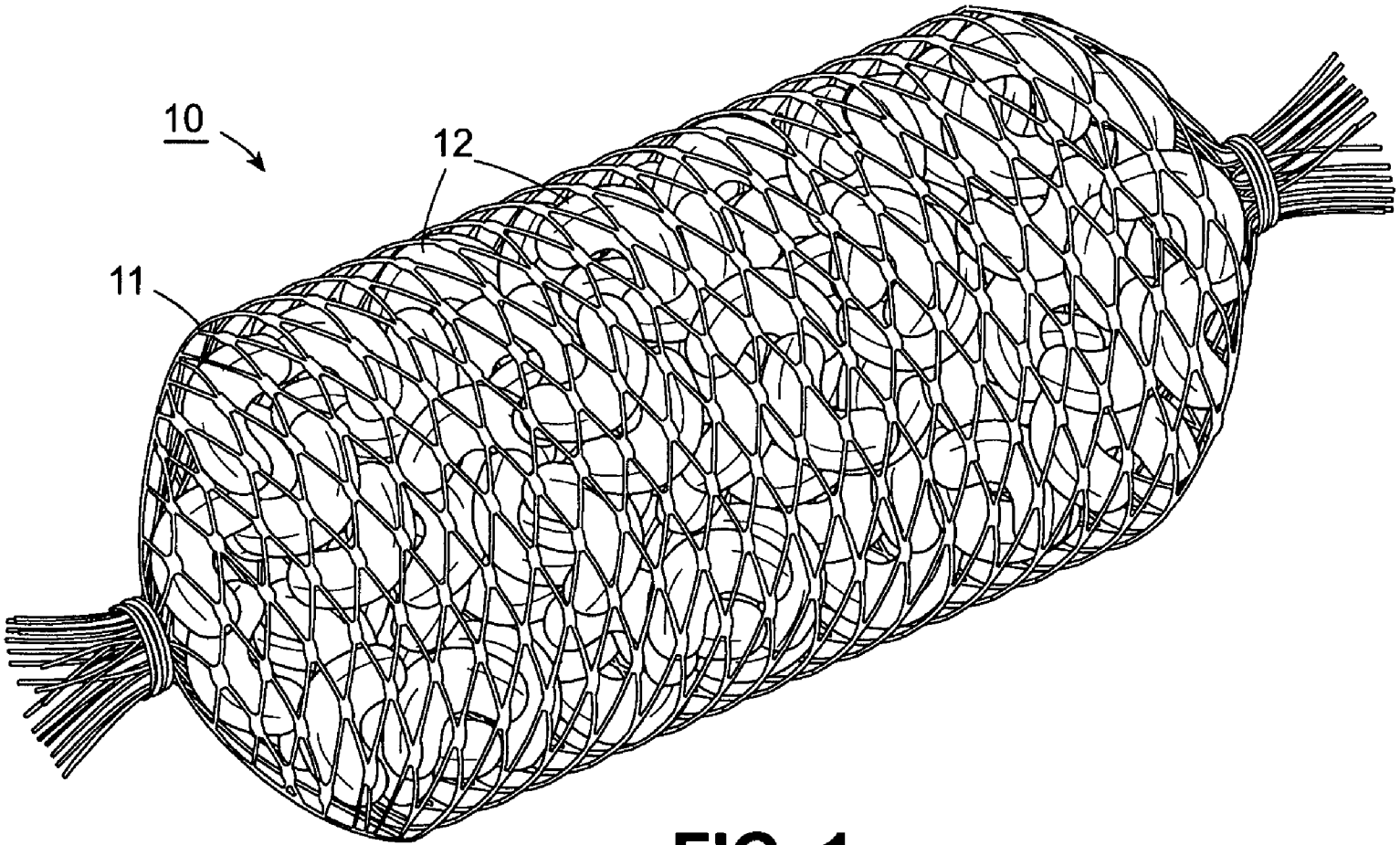
FIG. 1 illustrates a perspective view of a drainage element constructed in accordance with the invention.

Referring to FIG. 1, the drainage element 10 is of rigid ovate cross-sectional shape and is comprised of a tube 11 having closed opposite ends and a mass of loose fill elements 12 of polymeric material of non-spherical shape disposed within the tube 11 between the ends in a tightly compacted state. The shape and compaction of the loose fill elements 12 are characterized in that the elements 12 resist movement relative to each other thereby imparting a degree of rigidity to the drainage element 10 that resists deformation of the drainage element 10 from the ovate cross-sectional shape imparted upon manufacture under a loading of at least 2 psi imposed coaxially of the major axis of the cross-section of the drainage element 10 when disposed vertically. For example, the loose fill elements 12 are characterized in having shapes that interlock with each other when compressed together, such as C-shapes, E-shapes, hemispherical shapes, and the like.

Figure 3:
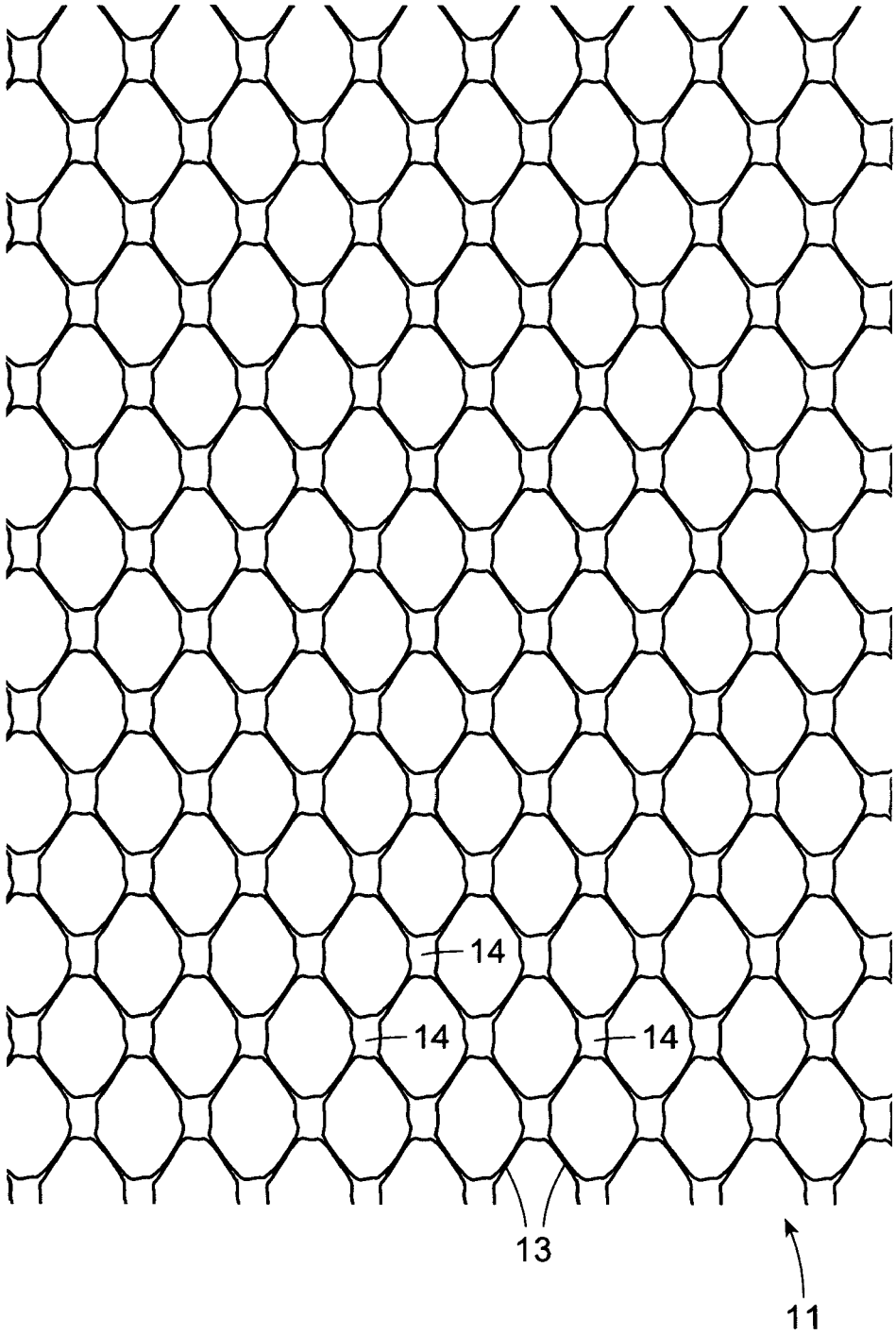
FIG. 3 illustrates a view of a partial section of a plastic mesh fabric of monofilaments used in accordance with the invention.

The tube 11 is made of a conventional plastic mesh fabric to be permeable to the passage of water or other effluent while being able to retain the elements 12 in place. For example, the tube 11 is made as shown in FIG. 3 of plastic monofilaments 13 that are crisscrossed on each other and bonded together at the crossing points by enlarged welds 14. Typically, this mesh is relatively stiff. The diameter of the tube 11 may be in the range of from 4 inches to 14 inches or more depending on the ultimate use of the drainage element 10.

Figure 4:
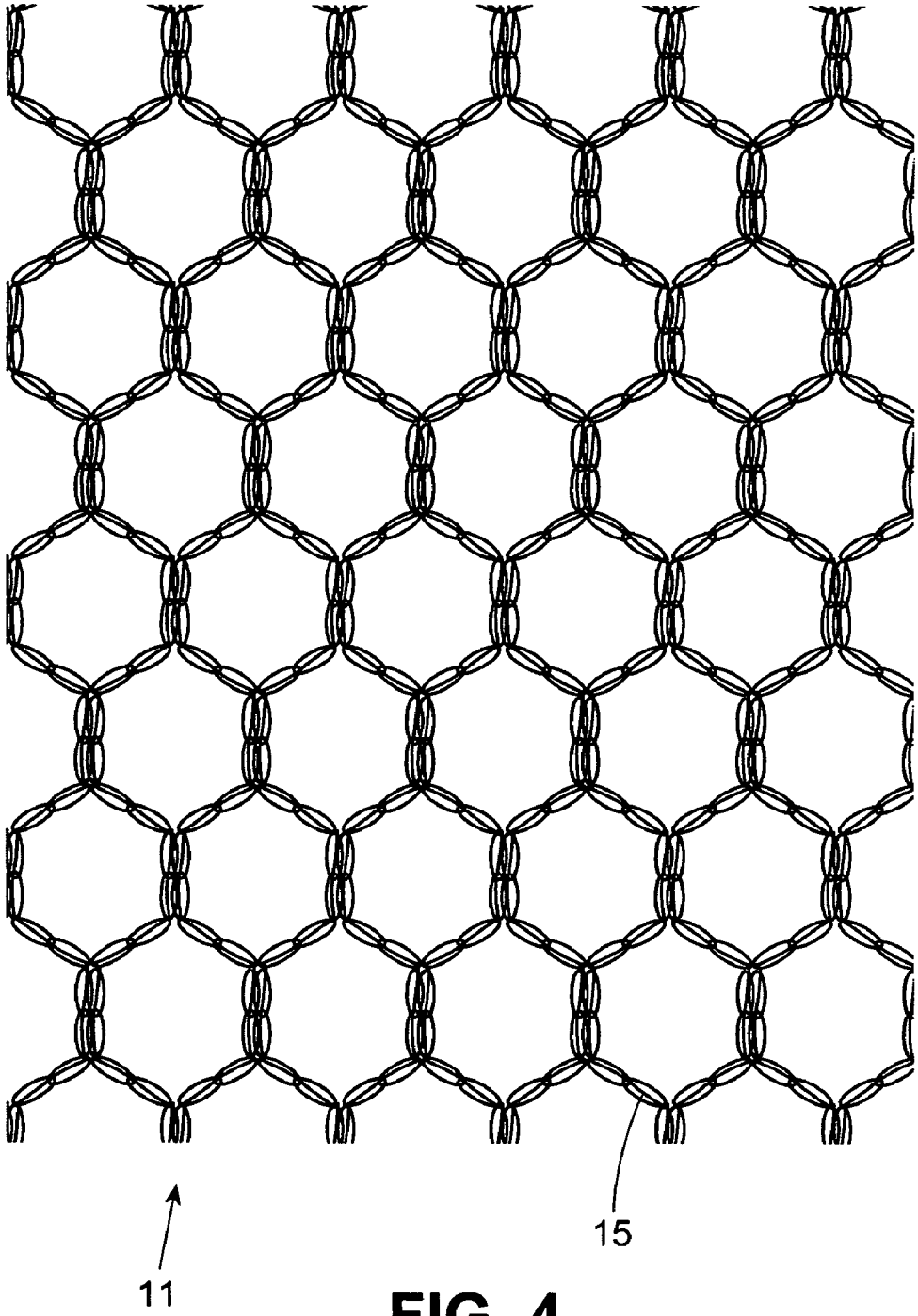
FIG. 4 illustrates a view of a section of a knitted mesh fabric of multi-filaments used in accordance with the invention.

Alternatively, the tube 11' may be made as shown in FIG. 4 of knitted plastic multifilaments 15.

Figure 5:
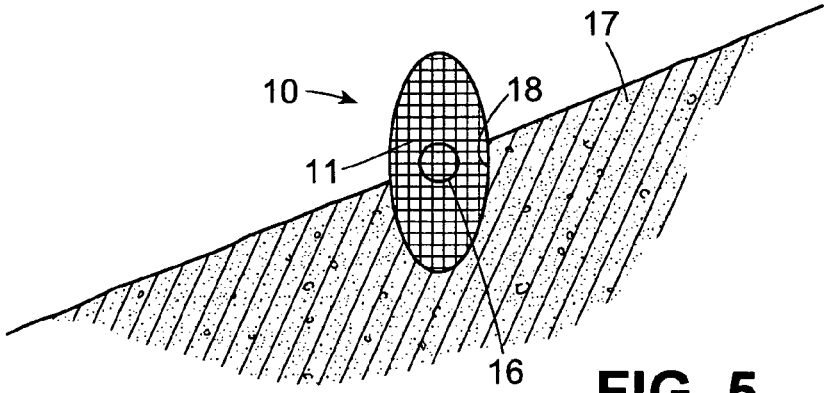
FIG. 5 illustrates a cross-sectional view a drainage element placed in a trench on a hillside in accordance with the invention.

Referring to FIG. 5, wherein like reference characters indicate like parts as above, the drainage element 10 may also have a length of perforated pipe 16 within the tube 11 and loose fill elements 12 with respective ends of the pipe 16 extending from respective ends of the tube 11 for connection to an adjacent pipe in a drainage system.

Figure 2:
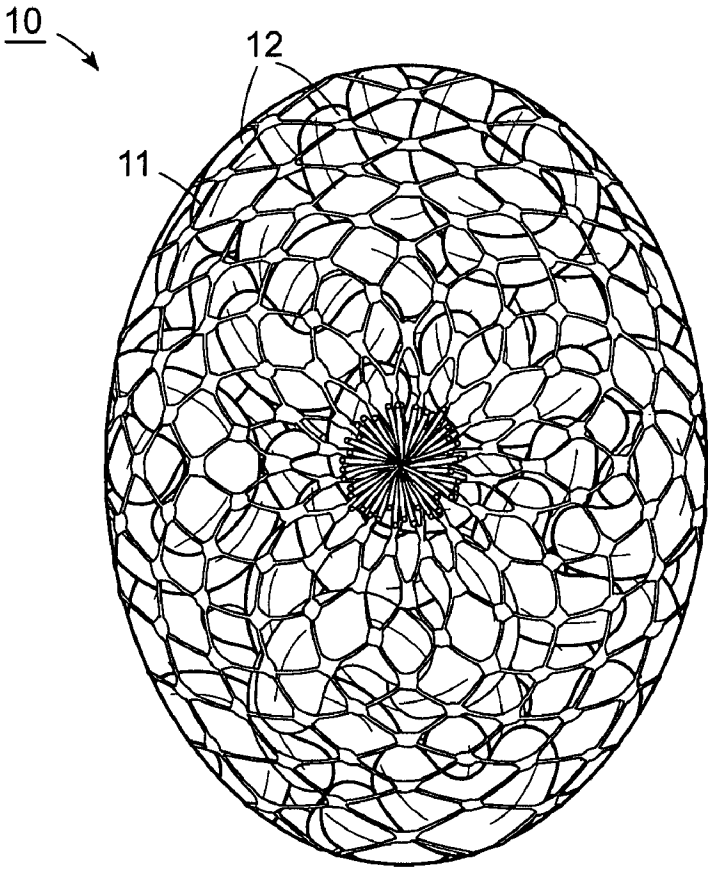
FIG. 2 illustrates a cross-sectional view of the drainage element of FIG. 1.

The ovate cross-sectional shape of the drainage element 10 is of elliptical shape as indicated in FIG. 2 with a length of 12 inches on the major axis and a length of 8½ inches on the minor axis. Other dimensions may, of course, be provided to the drainage element 10.

Referring to FIG. 5, the drainage element 10 is particularly useful for drainage on a hillside 17 or other sloped surface that receives water. In this respect, the drainage element 10 is positioned in a trench 18 that is cut into the hillside 17. In the Illustrated embodiment, the drainage element 10 is disposed with the major axis perpendicular to the trench 18, that is, with the major axis vertical. In addition, the upper section of the drainage element 10 is exposed so that water running down the hillside 17 may flow directly into the upper section of the drainage element 10.

The exposed part-circumferential portion of the drainage element 10 facing uphill has a plurality of openings for passage of water into the interior of the drainage element 10 whereas the back portion of the exposed upper section of the drainage element 10 may have a permeability to prevent the passage of water therethrough thereby acting as a wall so that the water entering the drainage element 10 is retained therein for collection through the perforated pipe 16. In this embodiment, the tube 11 may be initially made or not with a part-circumferential longitudinal section that is non-permeable with respect to water in order to form the back portion of the exposed upper section of the drainage element 10. Alternatively, the tube 11 may be provided with an added layer of a material that is non-permeable with respect to water in order to form the back portion of the exposed upper section of the drainage element 10.

Where the drainage element 10 includes a perforated pipe 16, the water that is accumulated within the drainage element 10 enters the pipe 16 and is drawn off to a suitable site.

Alternatively, the pipe 16 may be omitted from the drainage element 10 and placed below the drainage element 10 within the trench 18. In this case, the drainage element 10 would serve to direct the water flowing down the hillside 17 into the perforated pipe 16.

Several drainage elements 10 may be interconnected along a straight line in a like trench 18 in order to collect water running down the hillside 17. Alternatively, the trench 18 may be formed in a serpentine manner so that the exposed surfaces of the drainage elements 10 are also serpentine across the hillside to provide an increased area to receive water flowing down the hillside 17.

Figure 6:
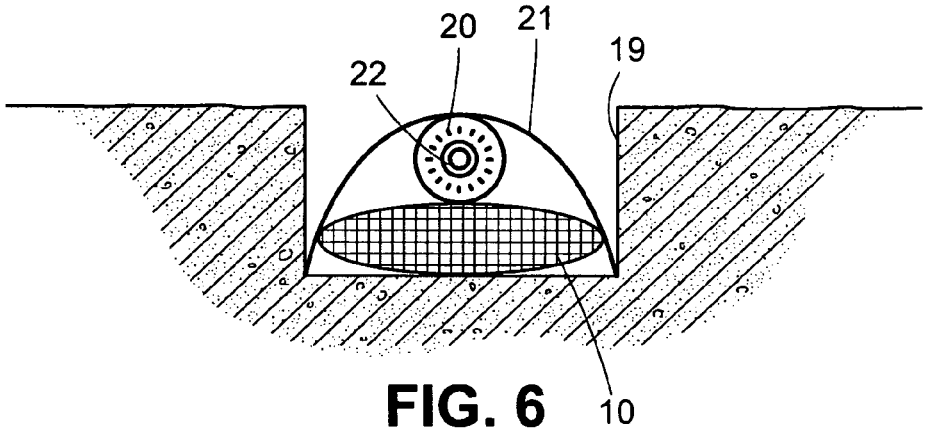
FIG. 6 illustrates a cross-section view of an arrangement of the drainage element with other drainage elements in a trench in accordance with the invention.

Referring to FIG. 6, wherein like reference characters indicate like parts as above, the ovate drainage element 10 may be placed on the bottom of a trench 19 with the major axis horizontally disposed. A second drainage element 20 of cylindrical cross-section is mounted over the ovate drainage element 10 and a water-permeable cover 21 is draped over the cylindrical drainage element 20 and ovate drainage element 10. Suitable backfill may then be placed in a trench 19 over the cover 21. This embodiment is useful where the ovate drainage element 10 with or without a perforated pipe therein replaces a pair of cylindrical drainage elements and is particularly useful for a septic tank arrangement wherein effluent is passed out of a pipe 22 in the cylindrical drainage element 20.

In this case, the effluent is able to flow out of the pipe 22 into the aggregate of the respective drainage elements 10, 20 and be dispersed through the trench 19 into the surrounding ground.

Figure 7:
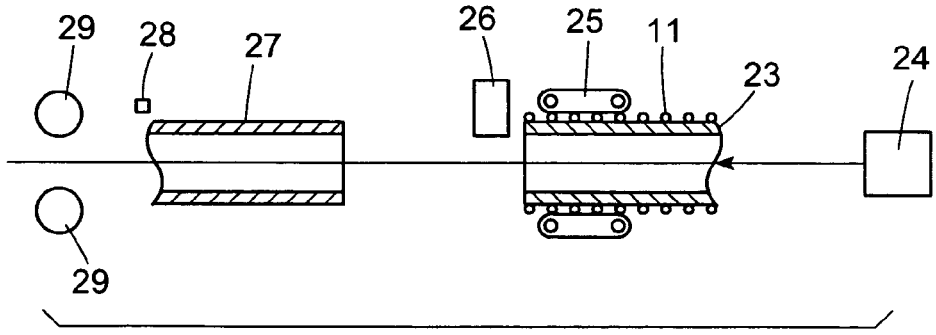
FIG. 7 illustrates a schematic view of an apparatus employed in the method of making a drainage element in accordance with the invention.

Referring to FIG. 7, in order to manufacture the drainage element 10, use is made of an apparatus that includes a hopper (not shown) for receiving loose fill elements, an elongated sleeve 23 that extends horizontally from the hopper, a blower 24 for blowing the loose fill elements from the hopper into the sleeve 23 and a capstan arrangement 25 near one end of the sleeve 23 for feeding the tube 11 off the sleeve 23.

The apparatus also employs a tying and cutting apparatus 26 at the end of the sleeve 23 for closing the tube 11 on itself.

In addition, a second sleeve 27 is spaced from the sleeve 23 to receive the forward end of a drainage element (not shown) that is being fabricated. A sensor 28 is also disposed within the second sleeve 27 at a pre-determined point for sensing the forward end of a drainage element being fabricated.

As an option, a perforated pipe feeder (not shown) may be provided for delivering a continuous length of perforated pipe within the sleeve 23. When this option is used, the loose fill elements surround the pipe in a circumferential manner and are then formed into an ovate shape or other suitable deformed shape.

The hopper (not shown) is of conventional structure to receive and deliver a flow of loose fill elements.

The blower 24 is an off-the-shelf item, for example, a Quickdraft 20 HP with Venturi that receives the loose fill elements from the hopper and blows the elements into the elongated sleeve 23. The operation of the blower 24 is such that only approximately six to eight inches of the sleeve 23 at the exit end is filled with the loose fill elements. The air that is blown into the sleeve 23 escapes through the loose fill elements and the exit end of the sleeve 23.

The sleeve 23 is of circular shape with an outside diameter, for example of 10 inches and is initially loaded with the tube 11 of a nominal 10 inch diameter and a length sufficient for the manufacture of a plurality of drainage elements. The tube 11 is bunched up on the sleeve 23 and is played off the sleeve 23 via the capstan arrangement 25 that is comprised of a pair of endless belt devices which are automatically operated in synchronism with the feed of the perforated pipe (not shown) in order to move the tube 11 off the sleeve 23.

When the apparatus is initially started, the forward end of the tube 11 is pulled off the sleeve 23 and gathered together on itself and tied or is gathered about one end of a perforated pipe (where used) and tied thereto. Thereafter, the blower 24 is actuated so that the loose fill elements are blown out of the sleeve 23 and into the space about the perforated pipe and within the tube 11. During this time, the pipe and tube 11 tied thereto advance into and through the second sleeve 27.

The sensor 28 within the second sleeve 27 is positioned at a pre-set point, for example ten feet, downstream from the exit end of the first sleeve 23. When the forward end of the drainage element being fabricated is sensed by the sensor 28, a signal is emitted to the blower 24 to stop the feeding of the loose fill elements into the sleeve 23. However, the movement of the pipe and the feeding of the tube 11 off the sleeve 23 continues for a short time sufficient to allow the rear end of the tube 11 to be tied about the pipe without interference from the loose fill elements. Alternatively, the feeding of the pipe and tube 11 may be interrupted or not during this time.

After the tube 11 has been tied to itself or to the pipe (where used) the tying and cutting apparatus 26 is actuated to sever the pipe and the tied net so as to form the rear end of a fabricated drainage element and the forward end of the next drainage element to be fabricated.

Thereafter, the blower 24 is again actuated and the process repeated.

As shown in FIG. 7, after forming, each drainage element is passed between at least a pair of parallel components, such as rollers 29, or a series of rollers (not shown) downstream of the second sleeve 27 to deform the drainage element from a cylindrical cross-sectional shape into an ovate cross-sectional shape. For example, from an original cylindrical cross-sectional shape with a diameter of approximately 10 inches, the drainage element was passed between rollers 29 spaced 8 inches apart to be reduced to an ovate shape having a minor axis of 8 inches and a major axis of 10.5 inches.

The rollers 29 are adjustable relative to each other to form a gap of from 2 inches to 16 inches to accommodate different sized drainage elements. In an alternative embodiment, the parallel components 29 may be in the form of two bars (not shown) that are located at the exit end of the sleeve 23 in order to deform the tubular unit being fabricated into an ovate cross-sectional shape. The bars would define a passage of approximately eight inches.

After deformation, the drainage unit is allowed to cure at an ambient temperature in order to effect expansion of the loose fill elements thereby rigidifying the drainage element in the ovate cross-sectional shape. For example, the rigidity of the drainage elements of ovate shape is characterized in that the drainage element tends not to deform under a load of 20 pounds applied coaxially of the major axis of the drainage element 10 and over a 10 square inch area of the drainage element 10 with the major axis disposed in a vertical plane, i.e. a loading of 2 psi.

Where the tube 11 is made of knitted plastic multifilaments, for example a "NET ALL" mesh material obtained from Tipper Tie, Inc. of Apex, N.C. several advantages are obtained. First, when this knitted mesh tube is taken off the sleeve 23, the tube necks down. That is, the diameter shrinks about an inch or so. After curing of the loose fill material and the consequent expansion, the knitted mesh tube is expanded to its original diameter with the tube then placing a greater radial compaction force on the loose fill material.

A second advantage is that the ties used to close the ends of the tube 11 tend not to slip from the knitted mesh.

The loose fill elements used for the drainage element or initially made from an expanded polystyrene with a density of from 0.2 to 5.0 pounds per cubic foot with a preferred range of from 0.2 to 1.0 pounds per cubic foot. In addition, the elements may be initially made with a shrinkage factor of from 3% to 30%.

The drainage element can be made of any length and cross-sectional shape and can filled with expandable loose fill elements with any shrinkage or density required. For example, the drainage element should have a length of at least five feet with a preferred length of from 10 feet to 20 feet.

Further, the sleeve 23 may have any suitable cross-sectional shape, such as an elliptical cross-sectional shape, or rectangular shape. In this case, there would be no need for the deformation components 29.

The drainage element may be used without incorporating a perforated pipe therein. Further, the drainage unit may be formed with a tube 11 that has an impermeable or solid bottom half so that the bottom half of the drainage element functions as a half-pipe in order to carry off water that may accumulate there.

The tube 11 may be customized with peripheral sections of different permeability to adapt to the use of the drainage element. For example for a drainage element to be placed on a hillside, the tube may have one quadrant that is to face uphill made with a fine mesh, as a coffee filter, to allow water to pass through while blocking sand and other similar particles from passing through. A second quadrant that is to face downhill, may be made with a larger mesh to allow water and sediment within the drainage element to pass through and a third and fourth quadrant that are to face downwardly may be made impermeable to act as a trough for water to flow off at a trailing end of the drainage element.

For ease of manufacture, the tube may be made of a mesh of uniform size and after formation of a drainage element, sections of the tube can be spray painted, or the like, to render those section impermeable. In this case, the loose fill elements that lie at the openings of the mesh in these sections would also be sprayed so that the coating of paint seals off the sprayed sections.

Due to the ovate cross-sectional shape, the drainage elements may be shipped more efficiently and stored in warehouses more efficiently because there is less wasted space between units as compared to stacks of cylindrical drainage elements.

The drainage elements are particularly useful for erosion control. As compared to cylindrical drainage units, a drainage unit of ovate cross-sectional shape presents a larger surface area for the collection of water when used with the major axis in a horizontal or substantially horizontal plane.

What is claimed is:

1. A drainage element comprising a tube defining an enclosed space and having at least a first part-circumferential portion having a plurality of openings therein for passage of water therethrough into and from said space;

a mass of randomly disposed discrete loose fill elements of light weight expanded polymer material within said tube to fill said space therein in a compacted state, said elements being characterized in having been expanded from an initial state to a post expanded state after filling of said tube therewith and in imparting a degree of rigidity to the drainage element in said expanded shape sufficient to maintain an expanded three dimensional shape of said tube, said tube and said compacted mass of loose fill elements defining a rigid drainage element of an ovate cross-sectional shape.

2. A drainage element as set forth in claim 1 characterized in being resistant to deformation under an external load of 20 pounds applied perpendicularly over an area of 10 square inches on a peripheral surface thereof.

3. A drainage element as set forth in claim 1 further comprising a length of perforated pipe within said tube and said loose fill elements therein with respective ends of said pipe extending through respective closed ends of said tube.

4. A drainage element as set forth in claim 1 wherein said tube is a plastic mesh fabric of monofilaments.

5. A drainage element comprising a tube having closed opposite ends and at least one water permeable section between said opposite ends; and a mass of expanded loose fill elements of polymeric material disposed within said tube between said ends in a compacted state, said tube and said compacted mass of loose fill elements defining a drainage element of an ovate cross-sectional shape having a rigidity along the length thereof characterized as not deforming under a load of 2 psi.

6. A drainage element as set forth in claim 5 wherein said tube is made of knitted plastic multifilaments and places said mass of elements under a radial compaction force along the length of said tube.

7. A drainage element as set forth in claim 5 wherein said expanded mass of elements is characterized in having been expanded from 3% to 30% of an initial state outside said tube to an expanded cured state within said tube.

8. A drainage element comprising a tube having closed opposite ends and at least one water permeable section between said opposite ends; and a mass of expanded loose fill discrete thermoplastic elements within said tube characterized in having been placed in said tube in a non-cured expanded initial state and thereafter expanded from said initial state to a further expanded cured state while in said tube to impart a degree of rigidity to said tube sufficient to maintain an expanded three dimensional shape of said tube and a degree of compaction to said elements and further characterized in that said elements are of a shape and degree of compaction to resist movement relative to each other;

said tube and said compacted mass of loose fill elements defining a rigid drainage element of an ovate cross-sectional shape.

9. A drainage element as set forth in claim 8 wherein said tube is made of a plastic mesh.

* * * * *